US005331759A

United States Patent [19]

Marceau et al.

[11] Patent Number: 5,331,759

[45] Date of Patent: Jul. 26, 1994

[54] EJECTION PORT LOCK FOR FIREARMS

[76] Inventors: Ian W. Marceau, 3604 Twilight Ct.; Carol A. Marceau, 2604 Twilight Ct., both of Oakton, Va. 22124; Keith F. McHue; Edith McHue, both of 47 Clarence Street, Glendale, N.S.W., Australia, 2285

[21] Appl. No.: 66,040

[22] PCT Filed: Oct. 16, 1991

[86] PCT No.: PCT/AU91/00476

§ 371 Date: Jun. 14, 1993

§ 102(e) Date: Jun. 14, 1993

[87] PCT Pub. No.: WO92/10714

PCT Pub. Date: Jun. 25, 1992

[51] Int. Cl.[5] ..... F41A 17/44

[52] U.S. Cl. ..... 42/70.11

[58] Field of Search ..... 42/70.11, 70.01, 66

[56] References Cited

U.S. PATENT DOCUMENTS

| | | | |
|---|---|---|---|
| 2,997,802 | 8/1961 | Robbins | 42/70.01 |
| 3,018,576 | 1/1962 | Riechers | 42/70.11 |
| 3,022,598 | 2/1962 | Wikstrom | 42/70.11 |
| 3,089,272 | 5/1963 | McKinlay | 42/70.11 |
| 3,360,880 | 1/1968 | Finnegan | 42/66 |
| 3,605,311 | 9/1971 | Hermann | 42/70.11 |
| 4,709,496 | 12/1987 | Johnson | 42/70.11 |
| 4,827,649 | 5/1989 | Sheehan | 42/70.11 |
| 5,235,763 | 8/1993 | Nosler et al. | 42/66 |

FOREIGN PATENT DOCUMENTS

| | | | |
|---|---|---|---|
| 2920679 | 11/1979 | Fed. Rep. of Germany | 42/70.11 |
| 4009372 | 10/1990 | Fed. Rep. of Germany . | |
| 8809475 | 12/1988 | PCT Int'l Appl. . | |

*Primary Examiner*—Stephen M. Johnson

*Attorney, Agent, or Firm*—Shoemaker and Mattare, Ltd.

[57] ABSTRACT

A multipurpose safety lock for firearms with automatic, semi-automatic or manually operated means of ejecting cartridge cases after firing is inserted in the ejection port when it is in the open position; and for firearms with a revolving cartridge-receiving cylinder, is inserted in the frame made vacant when the cylinder is in an open position. The lock comprises a body with a cylindrical assembly at the end inserted in the ejection port or the open frame, with a lock bolt extendible into the breech and barrel and lockable in that position by turning a key. While the lock bolt is in the locked condition in the breech and barrel the firearm cannot be put into firing condition and cannot be discharged.

5 Claims, 7 Drawing Sheets

EJECTION PORT LOCK FOR FIREARMS

BACKGROUND OF THE INVENTION

The present invention relates to a safety lock preventing the introduction of a live round to the firing chamber of firearms which eject by automatic, semi-automatic or manual means the spent cartridge case from the chamber of the weapon through an ejection port. A further application of the lock is to block alignment of the cylinder of so-called revolvers with the barrel, preventing firing.

The purpose of the lock is to render the firearm safe when not in its intended use, but to allow its rapid return to such use by quick removal of the lock from the firearm, which can remain with its magazine or cylinder in its loaded state.

An objective of the invention is to disable the firearm to prevent its accidental or unauthorised discharge by persons not in custody of the key separable from the body of the lock inserted in the firearm; yet to render its enablement rapid and simple by use of the key to permit removal of the lock from the firearm.

Another objective of the invention is to enable the custodian of the firearm and the lock to have the lock available at all times by carrying it on a key-ring or similar implement to which the key remains attached until separated from the firearm when the lock is installed in the firearm and to which the body of the lock becomes reattached on removal from the firearm.

A further objective of the invention is to enable custodians of more than one weapon, regardless of calibre or model, to require only one key for all locks emplaced in those firearms by virtue of the common-keying of the locking mechanism, thus preventing confusion among different keys in cases of emergency and inconvenience arising from the loss of the key to a particular lock.

SUMMARY OF THE INVENTION

According to the present invention the lock has a body comprising two mirror halves joined together at assembly; a lock bolt (a cylindrical, conical, pointed shaft) contained in an outer cylinder (which is an integral part of the body) of slightly greater diameter permitting the bolt to move back and forth within it, the assembly resembling a firearm cartridge; an activating slide (a cylindrical shaft) that gives motion to the lock bolt through a pivoted lever and is also part of the locking unit; the pivoted lever that connects the slide and lock bolt and transmits motion from one to the other; a lock cylinder assembly that allows or prevents movement of the slide through the body from side to side, depending on the position of the cylinder, having as components the activating slide, a locking dog (a moveable double lug section activated by a spring and a key), and the spring (which keeps an upward force on the locking dog); the key, retained in the cylinder when unlocked and removeble when the cylinder is locked; and a dedent plate offering slight resistance to movement of the lever in the unlocked position.

BRIEF DESCRIPTION OF THE DRAWINGS

An embodiment of the invention is now described by example only with reference to the accompanying drawings.

Figure 1:
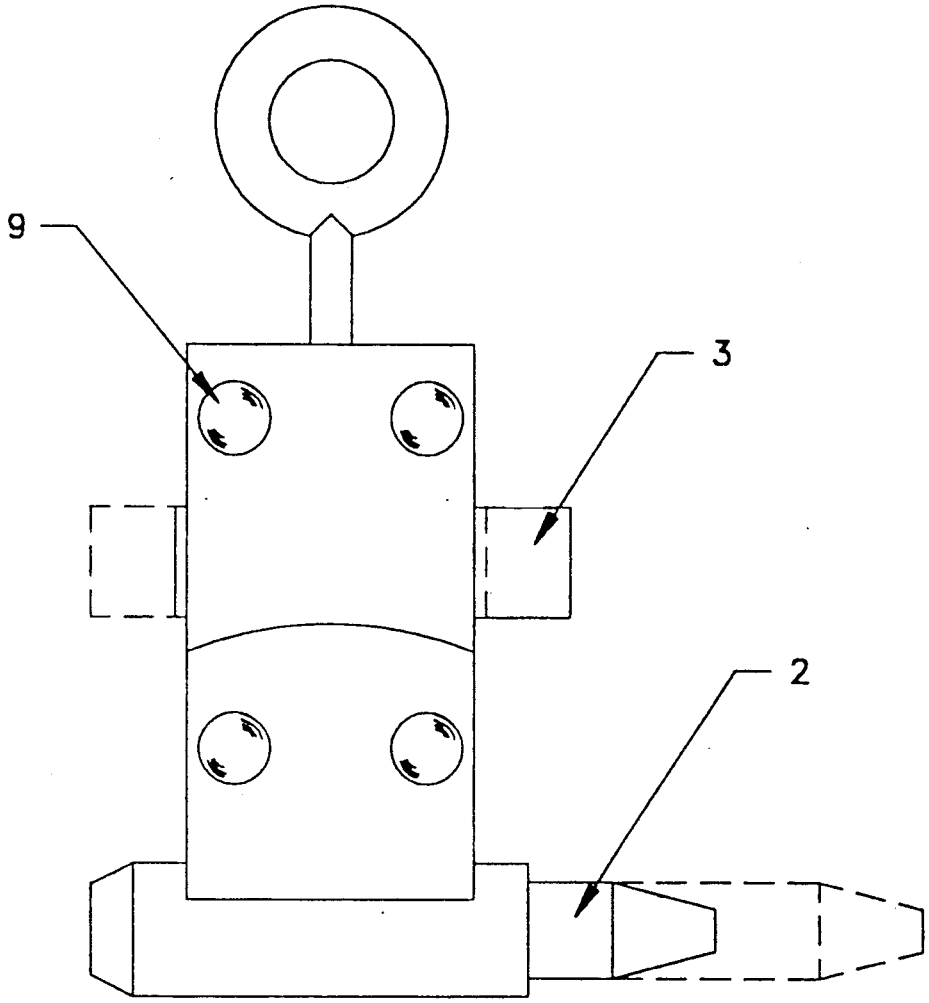
FIG. 1 is a side view of a lock in accordance with the invention with the activating slide 3 and the locking bolt 2 in solid outline in the unlocked position and in broken outline in the locked position; and the key inserted in the body.
Figure 2:
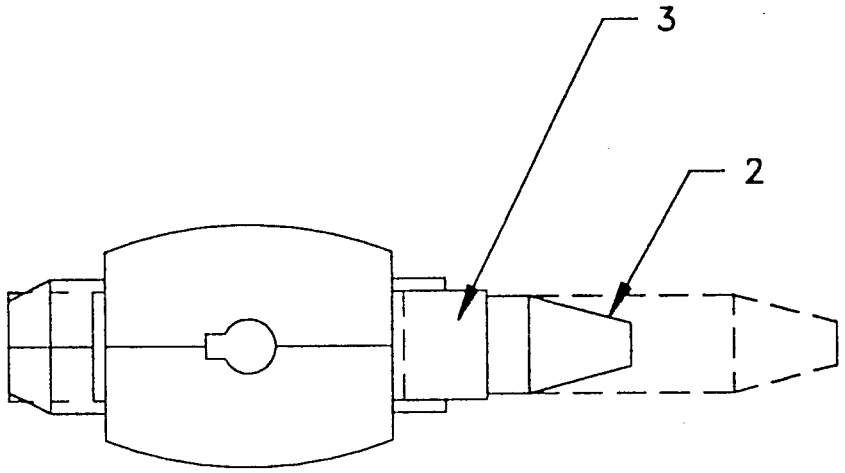
FIG. 2 is a key-end view of a lock with the key removed.

For firearms with ejection ports, the lock is inserted into the open port; the lock bolt 2 is extended into the rear of the barrel by rearward movement of the activating slide 3 which causes the pivoted lever 4 to rotate inside the body 1 of the device and to propel the lock bolt 2 in the forward direction; the lock bolt 2 is locked in the extended position by turning the attached key 6 through ninety degrees, immobilising the activating slide 3 and preventing operation of the lever 4 and retraction of the lock bolt. The key 6 is now detachable and is removed, leaving the device locked in the firing chamber and not removable until the lever 4 is released by inserting the key in the body 1 of the lock, and turning it through ninety (90) degrees. This allows forward movement of the activating slide 3 within the cylindrical channel in the body 1 to retract the lock bolt 2 from the barrel and permit removal of the lock from the ejection port allowing the loading mechanism to be activated and a live round to enter the chamber, so returning the firearm immediately to firing position.

In the application to revolvers the cylinder is swung open and the lock is inserted into the space in the frame vacated by the cylinder, the lock bolt is aligned with the rear of the barrel and extended into it using the activating slide and locked in place by turning the key. Return of the revolver to firing condition is done by retracting the lock bolt from the barrel by reinserting and turning the key through ninety (90) degrees to allow operation of the activating slide and by removal of the lock from the frame to allow the cylinder to be swung closed.

DESCRIPTION OF THE PREFERRED EMBODIMENT

In the particular embodiment shown, the body 1 comprises mirror image halves contoured externally to contain the components of the lock and shaped internally to accommodate them and to allow their movement in accord with the lock's operation. At the key 6 end the body is of a cross section to contain the lock cylinder 5 and its components the activating slide 3 the locking dog 7 and the spring 8. Between the key 6 and the lock bolt 2 ends of the lock the body 1 narrows to contain the lever 4 and widens again to a cylinder whose length and diameter fit the ejection ports and calibres of the firearms for which the lock is designed and within which cylinder the lock bolt 2 is extended and retracted by operating the activation slide 3.

The diameter of the lock bolt assembly (the cylinder part of the body 1 and the lock bolt 2) of a particular model of the lock is engineered for the smallest calibre of the range of firearms for which it is intended, and therefore fits calibres larger than it. For example, a lock with a lock bolt assembly sized for 9 mm calibre firearms provides a satisfactory fit in the barrels of firearms up to 0.45 calibre.

Figure 3:
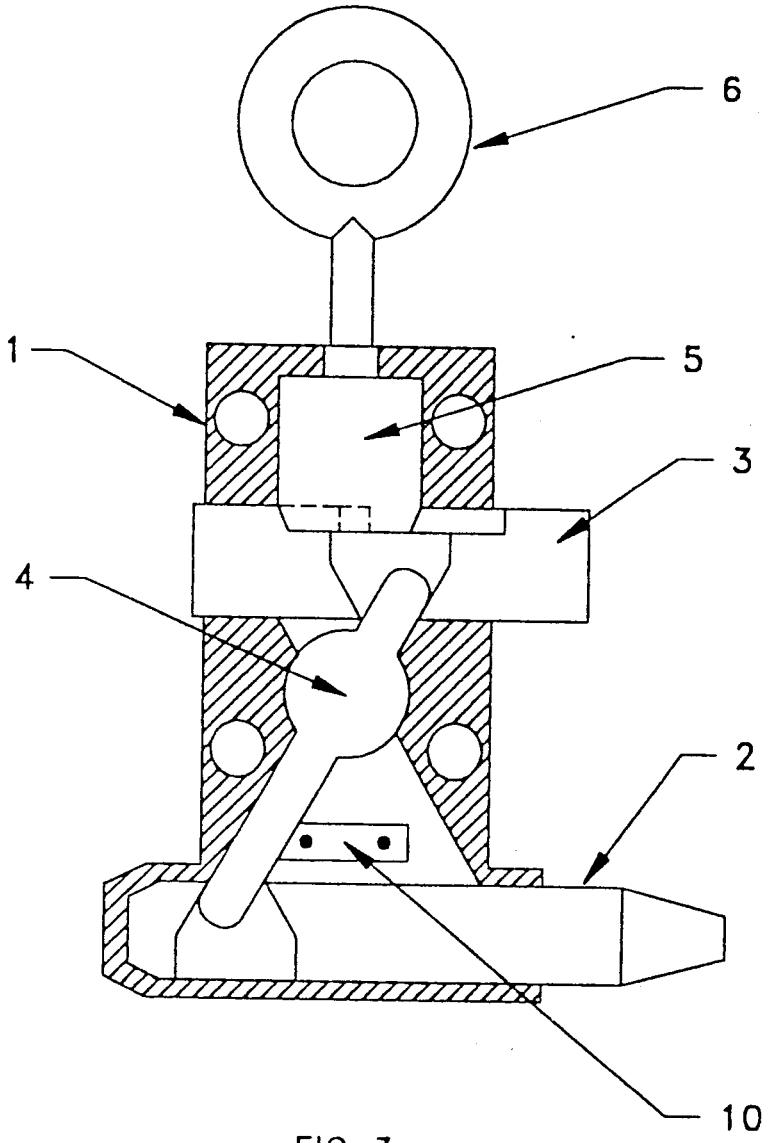
FIG. 3 is a sectional side view of the components of a lock and their positions in the unlocked condition.
Figure 7:
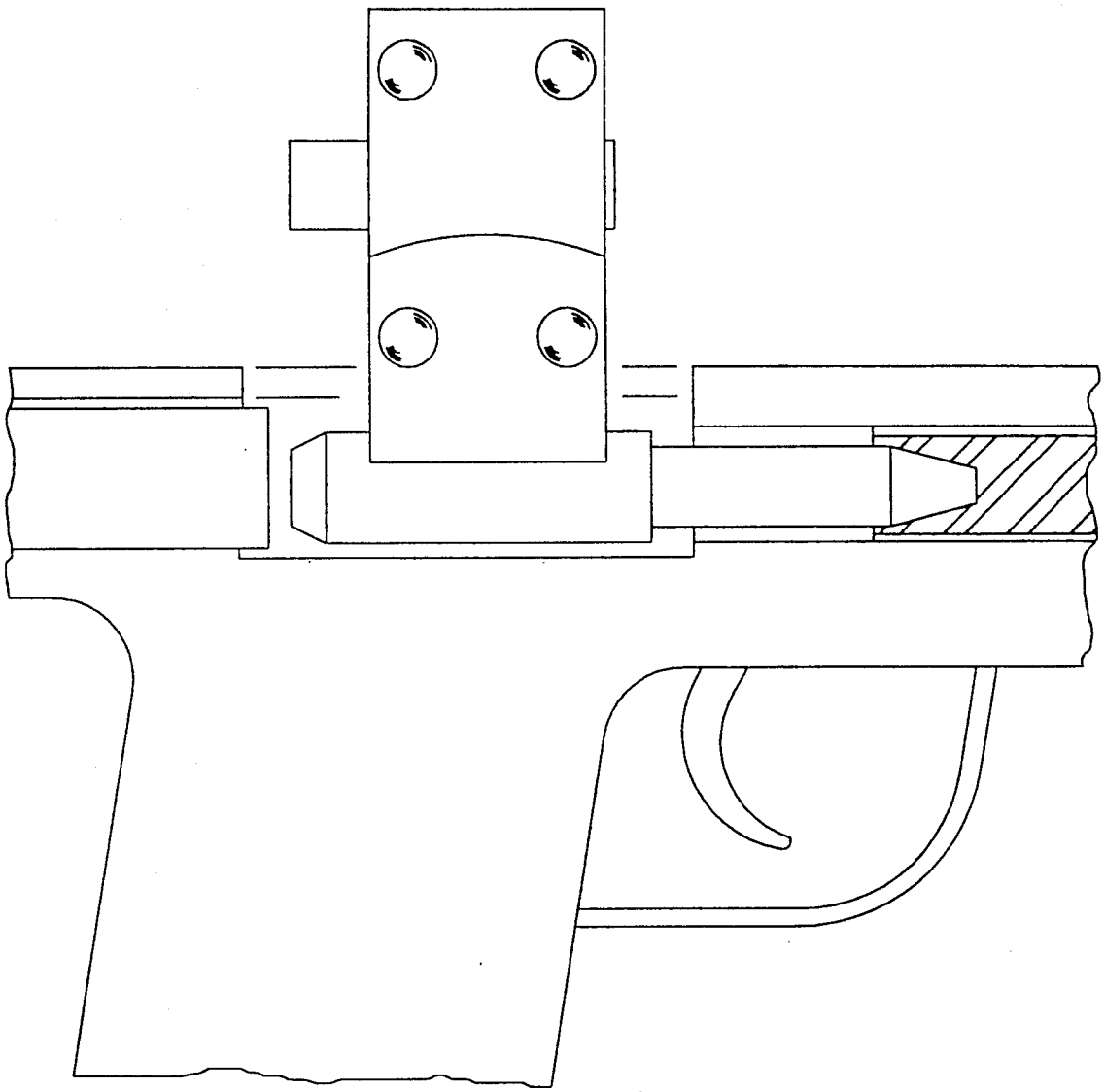
FIG. 7 shows the position of a lock in the ejection port of a firearm with the lock bolt extended into the barrel from the rear, in the locked condition with key removed.

The length of the lock bolt assembly in unlocked condition FIG. 3 determines whether the lock can be inserted in the ejection port or the cylinder frame of firearms. The closed end of the cylinder part of the body 1 is chamfered to ease insertion of the lock bolt assembly into the ejection port of firearms in which the fit is tight, thereby extending the range of firearm models which can be locked by one size of lock. The rear end of the lock bolt is chamfered to allow a snug fit with the body cylinder in which it sits as shown in FIG. 3. The forward end of the lock bolt 2 is also chamfered to ease its entry to the firing chamber. These features allow one lock to fit many models of firearms in a range of calibres. Firearm models with ejection ports or cylinder frames shorter or longer than the norm in calibre ranges selected for a lock model are catered for by lock bolt assemblies sized to fit them in the unlocked condition and with lock bolts of sufficient extension into the barrel in the locked condition FIGS. 4 and 7 to prevent removal of the lock from the firearm except by using the key and returning the lock bolt to the unlocked condition.

Figure 4:
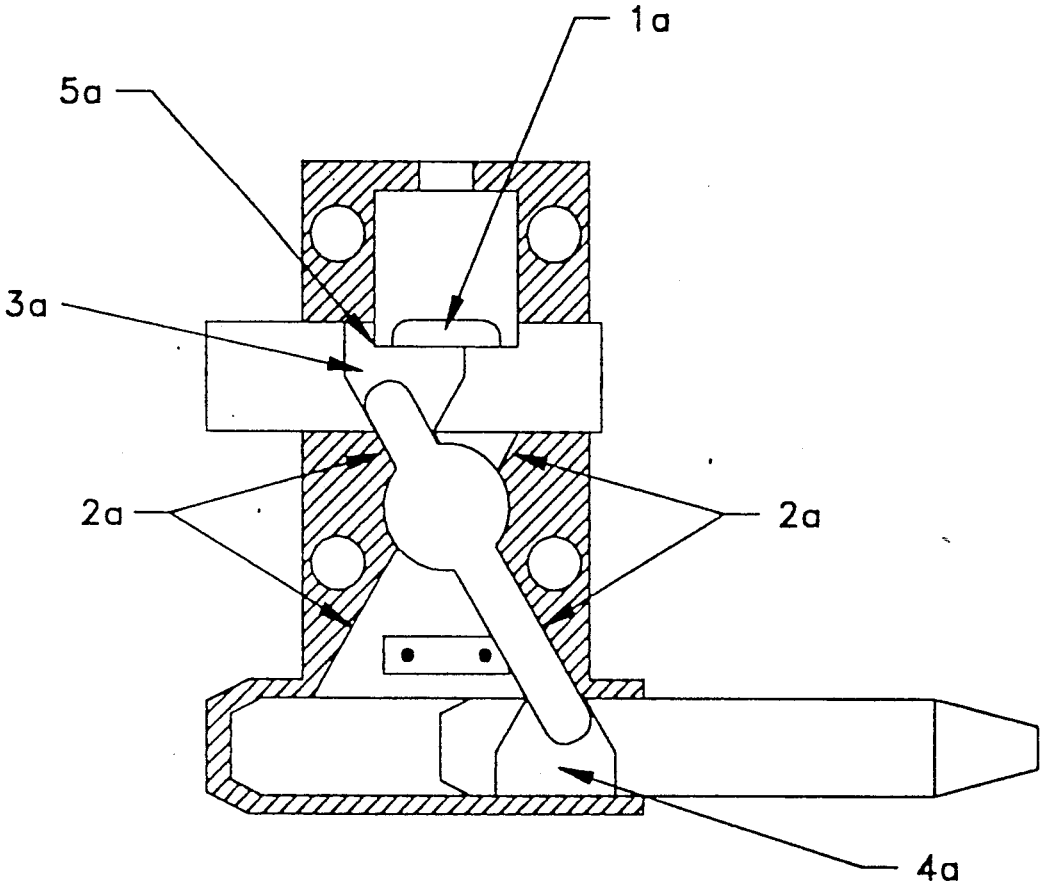
FIG. 4 is a sectional side view of the components of a lock and their positions in the locked condition.

The lock bolt 2 is equipped with a slot 4*a* in FIG. 4 near its rear into which the longer arm of the lever 4 in FIG. 3 fits. The geometry of the slot permits the arm to rotate within it and to move the lock bolt between the unlocked position FIG. 3 and the locked position FIG. 4 as the lever 4 is caused to pivot by pressure on either end of the activating slide 3.

The activating slide 3 has a slot 3*a* in FIG. 4 into which the shorter arm of the lever 4 fits and within which it rotates as the activating slide is moved from side to side. The travel of the activating slide 3 and the lock bolt 2 in either direction is controlled by the arms of the lever 4 contacting the angled faces 2*a* in FIG. 4 of the interior of the body 1. Extending the slot 3*a* on the key 6 side of the activating slide 3 is a flat cutout with length and curvature matching the outer diameter of the interior end of the lock cylinder 5 which the locking faces 5*a* of the lock cylinder legs 9*a* FIG. 6 abut in the locked condition FIG. 4 preventing travel of the activating slide and retraction of the lock bolt.

The lever 4 that connects the activating slide 3 and the lock bolt 2 FIG. 3 and transmits motion from one to the other is a flat bar thick enough to provide lateral strength with a central circular segment from which the two arms of unequal length extend at 180 degrees from each other. The central segment rests in a circular cutout interior to the body 1 in which it pivots and within which it is contained by the joined halves of the body 1. When the activating slide 3 transmits motion the lever passes over a raised projection of the dedent plate 10 in FIG. 3 which resists loose movement of the lever 4 in the unlocked condition.

The lock cylinder 5 has a flat surface at the outer, key 6 end and a channel groove 1*a* in FIG. 3 at its interior end through which the activating slide 3 moves in the unlocked condition FIG. 3. In the locked condition FIG. 4 the key 6 has turned the channel groove 1*a* at 90 degrees to the axis of the activating slide 3 which is at its rearmost point of travel. The key has been removed. The locking faces 5*a* of the legs 9*a* in FIG. 6 bordering the channel groove 1*a* of the lock cylinder 5 abut the ends of the cutout in the activating slide and stop its movement. At the external lateral edge of the key end of the lock cylinder is a 90 degree radial channel that engages a stop FIG. 5 in the key end of the body 1 and limits the turn of the lock cylinder assembly 5 to 90 degrees by action of the key 6.

Figure 5:
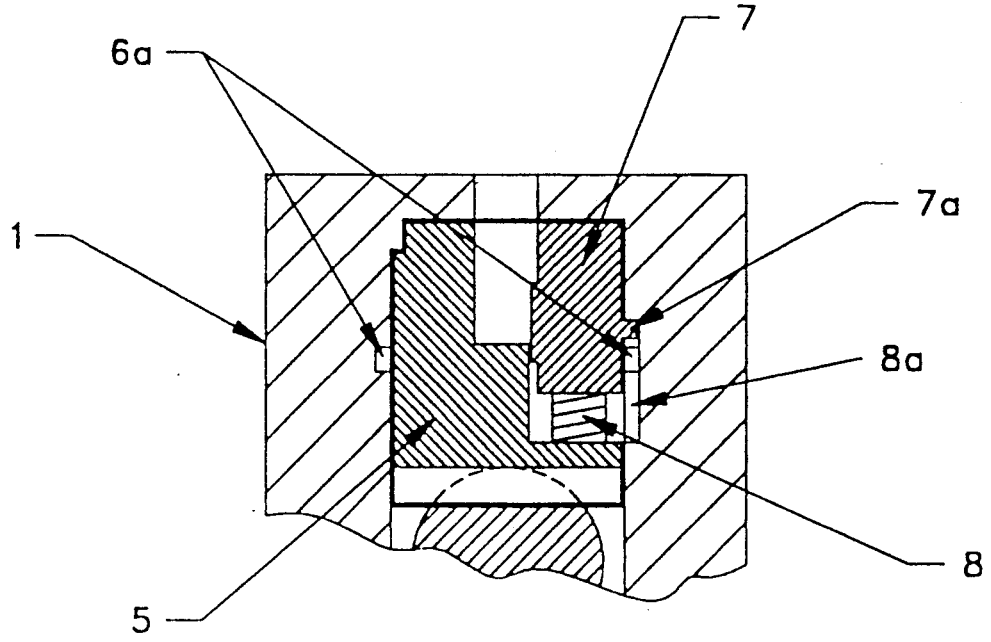
FIG. 5 is a sectional side view, at ninety (90) degrees to the view in FIG. 4, of the positions of components of a lock cylinder in locked condition.

The locking dog 7 in FIG. 5 is a moveable double lug section actuated by the coil spring 8 and the key 6, which fits into and slides within a longitudinal cutout section of the lock cylinder opposite the stop channel. The external lug 7*a* is located to fit and travel within the radial groove 6*a* in the body 1. The inner lug 10*a* maintains the correct alignment of the locking dog 7 in the lock cylinder 5 during its operation.

FIG. 5 shows the lock cylinder 5 in the locked condition in the body 1. The locking dog 7 is under spring 8 pressure and is forced to the key end (top) of the lock cylinder 5 causing the external lug 7*a* on the locking dog 7 to move out of alignment with the radial groove 6*a* in the body 1. The external lug 7*a* has moved out of the radial groove 6*a* into the slot 8*a* intercepting the radial groove 6*a* at 90 degrees to its axis and is positioned to place the legs 9*a* in FIG. 6 of the lock cylinder 5 at right angles to and within the cutout in the activating slide 3 thus preventing its movement.

Figure 6:
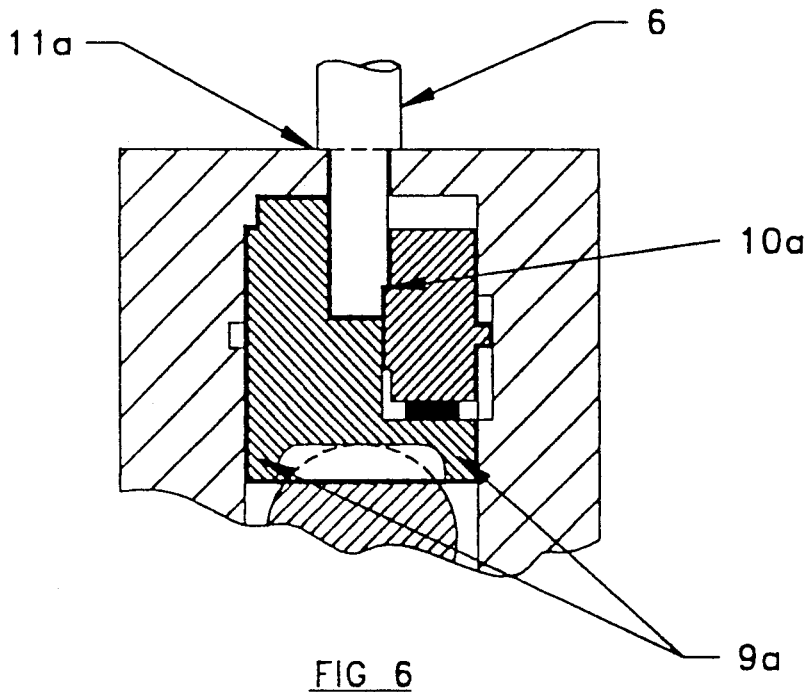
FIG. 6 is a sectional side view, at ninety (90) degrees to the view in FIG. 3, of the positions of components of a lock cylinder in unlocked condition.

In FIG. 6 the key 6 has been inserted in the lock and turned through 90 degrees, placing the lock cylinder 5 in the unlocked condition. The key 6 has a step of predetermined size which has contacted the inner lug 10*a* of the locking dog 7 and forced it down (away from the key end) compressing the coil spring until the face 11*a* of the key met the body 1. This put the external lug 7*a* of the lock cylinder 5 in line with the radial groove 6*a* of the body 1 and allowed the lock cylinder 5 to rotate by 90 degrees bringing the legs 9*a* of the lock cylinder 5 parallel to the axis of the activating slide 3 and allowing it to move from side to side again.

The embodiment described above is by way of example only and is illustrated by reference to a range of firearms with calibres from 9 mm to 0.45 inch calibres, but it must be realised that the invention is universally applicable to firearms of lesser and greater calibres including handguns, rifles and shotguns that eject spent cartridge cases by automatic, semi-automatic or manual means or that have revolving cylinders by which cartridges are aligned with the barrel and fired through it.

The lock can be made from hardened material including metals and plastics using effective methods of shaping those materials.

Modifications are possible within the scope of the invention.

We claim:

1. A removable lock for insertion into the breech of a firearm having an ejection port through which spent cartridges are ejected from the breech, said lock including a body adapted to fit within the ejection port and to extend into the breech, and means within the body for preventing removal of the body from the breech to prevent chambering of a live cartridge, said means comprising:

a lock bolt slidably mounted in the body, and extendable forward from the body into the barrel of the firearm, an activating slide, slidably mounted in the body and having opposite ends protruding from the body, for moving the lock bolt, a pivoted lever interconnecting the bolt and the slide, and a lock cylinder, operable by a key, for preventing movement of the activating slide in a locked condition, whereby, in an unlocked condition, the activating slide can be moved with respect to the body by applying finger pressure on either end of the slide, to move the lock bolt.

2. A lock according to claim 1 wherein, in the unlocked condition, rearward movement of the slide imparts forward motion to the lock bolt whose forward end extends outward from a hollow cylinder of the body in which it is contained, and forward movement of the slide causes retraction of the lock bolt into the body, and wherein the lock cylinder can be turned to the locked condition, rendering the activating slide immovable, only when the lock bolt is fully extended.

3. A lock according to claim 1, wherein the lock cylinder has an end abutting the activating slide, said end having a concave channel groove sized to permit the activating slide to pass through it in the unlocked condition, and legs forming lateral edges of said channel groove which, when the lock cylinder is turned by a key and held in position at 90 degrees to the activating slide's axis in the locked condition, engage a flat longitudinal cutout section of said activating slide facing a key end of the body, and immobilize the slide, thus preventing transmission of motion to the lock bolt and its retraction into the body of the lock.

4. A lock according to claim 1, 2 or 3, wherein said lever comprises a central, circular portion that pivots in a recess in the body, and opposing arms of unequal length extending linearly to intersect slots in the activating slide and the lock bolt, and wherein an angle through which the lever can pivot and therefore a length of travel of the activating slide and the lock bolt are delimited by angled faces extending radially from the pivotal recess in the body.

5. The invention of claim 4, further comprising a detent plate having at least one raised portion in the path of one of said lever arms, for resisting loose movement of the lever in the unlocked condition.

* * * * *